US011013324B2

(12) United States Patent
Cattaneo

(10) Patent No.: US 11,013,324 B2
(45) Date of Patent: May 25, 2021

(54) FOOT SYSTEM FOR PARTS OF FURNITURE AND FURNISHING ITEMS WITH FRONT ADJUSTMENT LEVELLING

(71) Applicant: Leonardo S.r.l., Figino Serenza (IT)

(72) Inventor: Carlo Cattaneo, Figino Serenza (IT)

(73) Assignee: Leonardo S.r.L, Figino Serenza (IT)

( * ) Notice: Subject to any disclaimer, the term of this patent is extended or adjusted under 35 U.S.C. 154(b) by 0 days.

(21) Appl. No.: 16/335,266

(22) PCT Filed: Oct. 9, 2017

(86) PCT No.: PCT/EP2017/075675

§ 371 (c)(1),
(2) Date: Mar. 21, 2019

(87) PCT Pub. No.: WO2018/069248

PCT Pub. Date: Apr. 19, 2018

(65) Prior Publication Data

US 2019/0281981 A1 Sep. 19, 2019

(30) Foreign Application Priority Data

Oct. 13, 2016 (IT) ..... 102016000102943

(51) Int. Cl.
*A47B 91/02* (2006.01)

(52) U.S. Cl.
CPC ..... *A47B 91/028* (2013.01)

(58) Field of Classification Search
CPC ..... A47B 91/028; A47B 91/02; F16M 11/24
USPC ..... 248/188.1, 188.2, 188.3, 188.4, 188.5
See application file for complete search history.

(56) References Cited

U.S. PATENT DOCUMENTS

| | | | | |
|---|---|---|---|---|
| 1,417,639 A * | 5/1922 | Sterner | A47B 91/028 248/188.4 |
| 1,632,383 A * | 6/1927 | Seiden | A47B 91/028 248/188.4 |
| 3,641,620 A | 2/1972 | Hage | |
| 4,991,805 A * | 2/1991 | Solak | F16M 7/00 248/188.4 |
| 5,398,620 A * | 3/1995 | Rouch | F16M 7/00 108/1 |

(Continued)

FOREIGN PATENT DOCUMENTS

| | | |
|---|---|---|
| AU | 2009227484 | 5/2010 |
| DE | 9310159 | 2/1994 |
| EP | 1698253 | 9/2006 |

OTHER PUBLICATIONS

International Search Report and the Written Opinion dated Nov. 23, 2017 From the International Searching Authority Re. Application No. PCT/EP2017/075675. (11 Pages).

(Continued)

*Primary Examiner* — Muhammad Ijaz

(57) ABSTRACT

A foot system for parts of furniture and furnishing items with front adjustment levelling, wherein a foot (11) is positioned between a base or bottom (12) of a piece of furniture and a floor (P) in a space reduced in height (H), said foot (11) containing in its interior a height adjustment mechanism actuated from a hole or actuating point (13) by means of a manoeuvring tool (14), the hole or actuating point (13) being positioned, in the system, at a lower free end of the foot (11) resting on the floor (P).

10 Claims, 5 Drawing Sheets

(56) References Cited

U.S. PATENT DOCUMENTS

| | | | | |
|---|---|---|---|---|
| 2007/0205342 | A1* | 9/2007 | Gabriel | F16M 7/00 248/188.4 |
| 2010/0276564 | A1* | 11/2010 | Fetzer | D06F 39/125 248/678 |
| 2016/0235200 | A1 | 8/2016 | De Bruin | |
| 2019/0116976 | A1* | 4/2019 | Cattaneo | F16B 12/44 |
| 2019/0281981 | A1* | 9/2019 | Cattaneo | A47B 91/028 |
| 2019/0387882 | A1* | 12/2019 | Cattaneo | A47B 97/00 |

OTHER PUBLICATIONS

Communication Pursuant to Article 94(3) EPC dated Feb. 13, 2020 From the European Patent Office Re. Application No. 17778313.1. (5 Pages).

* cited by examiner

FOOT SYSTEM FOR PARTS OF FURNITURE AND FURNISHING ITEMS WITH FRONT ADJUSTMENT LEVELLING

RELATED APPLICATIONS

This application is a National Phase of PCT Patent Application No. PCT/EP2017/075675 having International filing date of Oct. 9, 2017, which claims the benefit of priority of Italian Patent Application No. 102016000102943 filed on Oct. 13, 2016. The contents of the above applications are all incorporated by reference as if fully set forth herein in their entirety.

FIELD AND BACKGROUND OF INVENTION

The present invention relates to a foot (or leg) system for parts of furniture and furnishing items with front adjustment levelling.

A series of patent applications and patents are currently known, that describe various foot or leveller systems adjustable from the front. These systems are, for example, object of patents EP-A-05751960.5, EP-A-13162252.4, EP-A-14172508.5, and IT1408681, AU-2009227484, DE-9310159, US-2016/235200, U.S. Pat. Nos. 1,632,383, 3,641,620 and EP-1698253.

For technical and also aesthetical purposes, furniture producers have recently shown the tendency of reducing the distance between the floor and the base of the furniture (baseboard), to measurements of less than about 70/80 mm.

In these situations, due to the reduced space between the floor and furniture, it is difficult to have manual access to the feet to be able to adjust them.

In order to solve this problem, some furniture producers produce a hole in the base of the furniture through which the height of the foot can be adjusted.

Other producers, so as not to ruin the inner appearance of the base of the furniture and to avoid having to perforate the bases, have asked for foot systems to be produced that can be easily actuated from the front part of the furniture, regardless of the reduced spaces available.

The above-mentioned patents solve the problem in most situations.

There are cases, however, in which the space between the base of the furniture and the floor is further reduced and the systems so far existing, mentioned above, cannot be used.

For specific technical requirements (for example in a refrigerator base) and/or aesthetic requirements, some furniture manufacturers have come up with the need for foot systems adjustable from the front that can be used in a space of only 20/30 mm.

In these situations, it is very difficult or even impossible to use systems currently existing.

The retracted position of the foot with respect to the front of the furniture, in fact, combined with the reduced manoeuvring space between the base and floor, hinders the operator in the adjustment.

This reduced space compels the operator to manoeuvre the adjustment tool keeping it substantially parallel to the floor and very close to it.

This position is particularly unsuitable for manoeuvring, to the extent that it is difficult to insert the tool in the actuating point and rotate it without his hand interfering with the floor.

SUMMARY OF THE INVENTION

The general objective of the present invention is therefore to provide a foot system for parts of furniture and furnishing items with front adjustment levelling capable of solving the above drawbacks of the known art in an extremely simple, economical and particularly functional manner.

A further objective of the present invention is to provide a foot system for parts of furniture and furnishing items with front adjustment levelling with extremely reduced encumbrances and with improved access from outside the furniture.

Another objective of the present invention is to provide a foot system for parts of furniture and furnishing items with front adjustment levelling also for specific technical destinations such as refrigerator bases.

The above objectives are achieved by a foot system for parts of furniture and furnishing items with front adjustment levelling produced according to the independent claim 1 and the following subclaims.

BRIEF DESCRIPTION OF THE SEVERAL VIEWS OF THE DRAWINGS

The structural and functional characteristics of the present invention and its advantages with respect to the known art will appear even more evident from the following description, referring to the enclosed schematic drawings, which show an embodiment of the invention itself. In the drawings.

DESCRIPTION OF SPECIFIC EMBODIMENTS OF THE INVENTION

Figure 1:
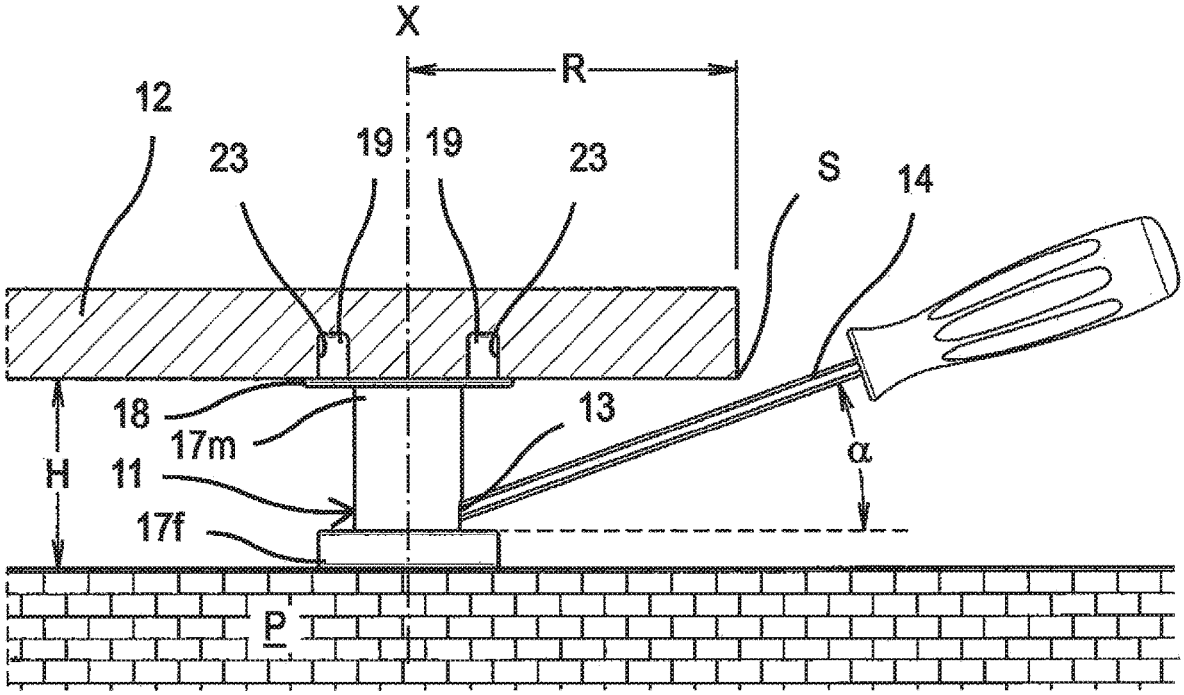
FIG. 1 is a raised side view illustrating a foot system for parts of furniture and furnishing items with front adjustment levelling according to the invention.

With reference first of all to FIG. 1, this shows in a raised side view, a foot system for parts of furniture and furnishing items with front adjustment levelling according to the invention.

A foot 11 is positioned between a base or bottom 12 of a piece of furniture and a floor P in a space reduced in height H, left by the arrangement of the parts.

The foot 11, which contains in its interior an adjustment mechanism in height, has a hole 13 for the passage of a manoeuvring tool 14.

This hole 13 is formed in the body of the foot 11 in a lower area which is situated close to the floor P, opposite the base 12 of the furniture. In particular, the foot 11 is of the telescopic type and comprises a lower fixed part 17*f* with respect to the floor P and an upper movable part 17*m* integral with the base 12 of the furniture and which can be moved with it during the adjustment.

In this way, the actuating point of the adjustment mechanism (coinciding with the hole 13) is adjacent to the floor P, positioned at a lower free end of the foot 11 in the fixed part 17*f* of the foot 11 resting on the floor P.

It should also be considered that the foot 11 is positioned with one of its axes X in a retracted position of a space R with respect to a front part of the furniture or base 12.

As the space H between the base 12 of the furniture and the floor P is reduced, the manoeuvring tool 14 can be tilted by an angle α with respect to the floor P indicated as the manoeuvring angle of the adjustment mechanism. The angle α is in relation to the ratio existing between the retracted space R of the axis X of the foot 11 with respect to the front part of the furniture and the space H existing between the base 12 of the furniture and the floor P. Said angle α preferably ranges from 0° to 40°, preferably 30°.

It can be observed that in an arrangement according to the present invention, in order to be able to easily adjust the foot 11, the actuating point of the mechanism (coinciding with the hole 13) has been positioned in the lower part of the foot 11, unlike its arrangement in the known art where it is provided above. This actuation position is therefore adjacent to the floor and opposite the base 12 of the furniture.

The foot 11, in its upper movable part 17*m* at one of its free ends, provides a flange 18 which is provided with one or more pins 19. Said pins 19 are inserted in specific seats 23 formed in the base 12 which help in orienting the foot in its insertion phase between the base 12 and the floor P.

This very particular and new arrangement allows a greater manoeuvring angle α for the tool 14 with respect to that possible with the normal feet currently used. This makes it possible to reach the actuating point avoiding an edge S of the base 12 of the front of the furniture, in any case maintaining sufficient space for the operator's hand between the tool 14 and the floor P.

Figure 2:
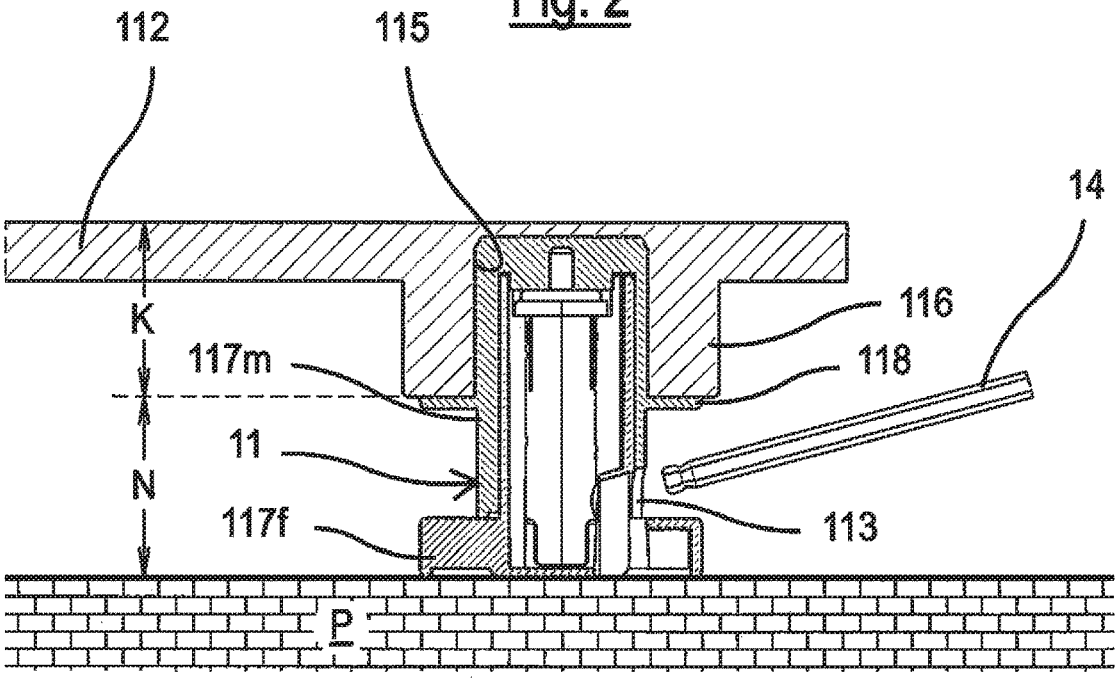
FIGS. 2 and 3 are two raised side views of a second embodiment of a foot system for parts of furniture and furnishing items with front adjustment levelling in two different positions, for example between a refrigerator base and the floor.
Figure 3:
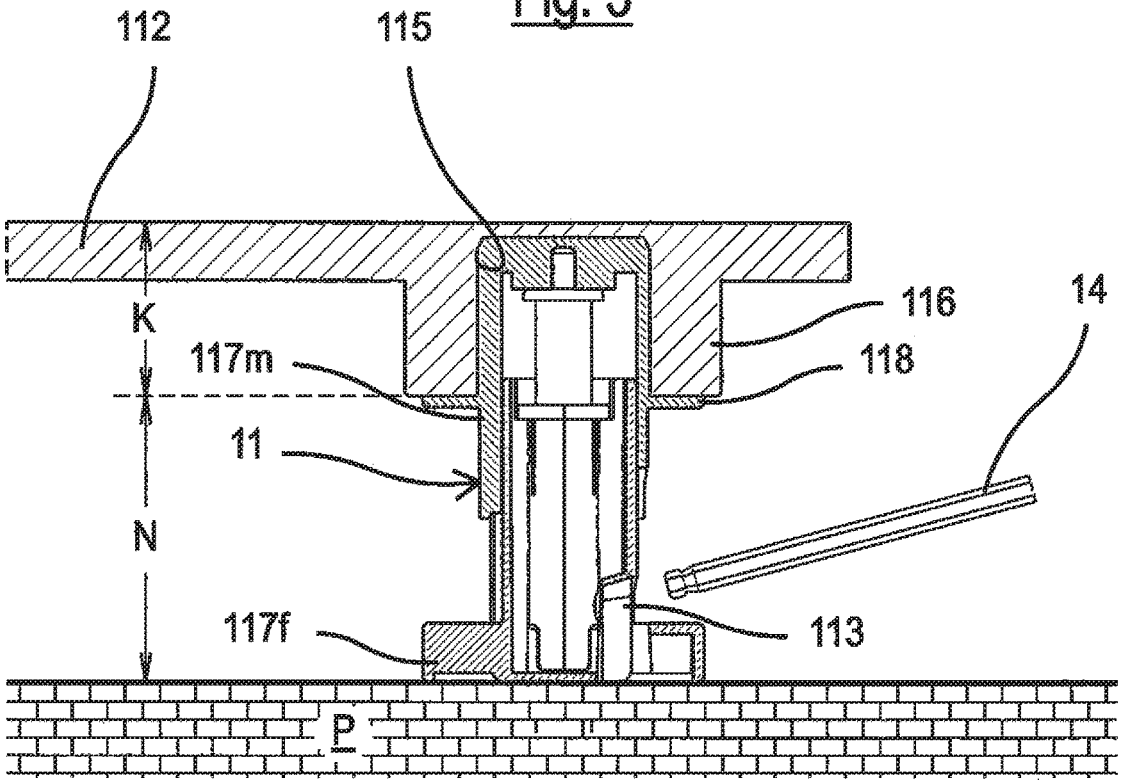

FIGS. 2 and 3 show, in two raised side views, a second embodiment of foot system for parts of furniture and furnishing items with front adjustment levelling. FIGS. 2 and 3 show two different positions, one lowered and the other raised, for example between a refrigerator base 112 and a floor P.

This is actually a very extreme situation of space shortage between the refrigerator base and the floor.

In these even more extreme situations of available space between refrigerator base 112 and floor P, in order to ensure an ample adjustment, a thickness K of an extension 116 of the refrigerator base 112 towards the floor P, has been exploited. An engagement seat 115 of the foot 11 has been formed in the interior of this extension 116, for inserting part of the adjustment mechanism of the foot. Said seat 115 is specifically produced in said thickness K of the base 112.

In particular, a flange 118 has been formed in an upper movable part 117*m* of the foot 11, which is abutted beneath the extension 116 ensuring better support between the parts.

In this way, an extremely reduced distance N is obtained between the flange 118 and the floor P, in which the manoeuvring tool 14 can be passed.

The lower fixed part 117*f* of the foot is that which gives the system stability and is where the actuating point or hole 113 of the adjustment mechanism is situated, in a position close to or adjacent to the floor P.

Figure 4:
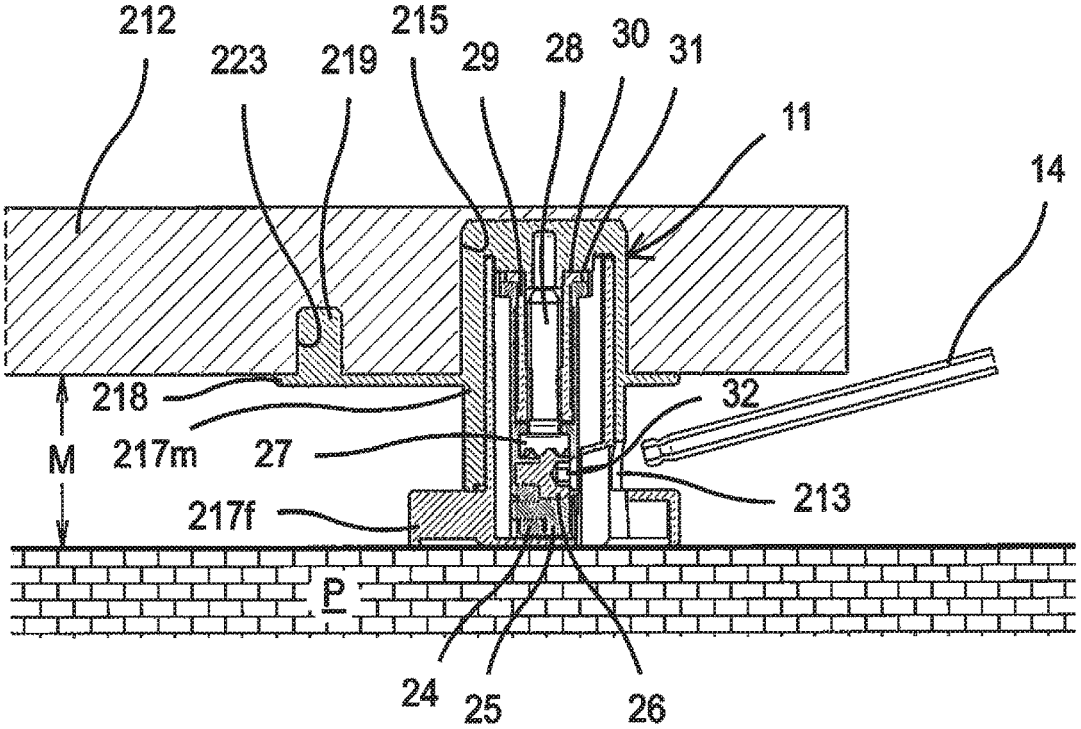
FIGS. 4 and 5 are two raised side views of a third embodiment of a foot system for parts of furniture and furnishing items with front adjustment levelling in two different positions, for example between a base or bottom of a piece of furniture and the floor.
Figure 5:
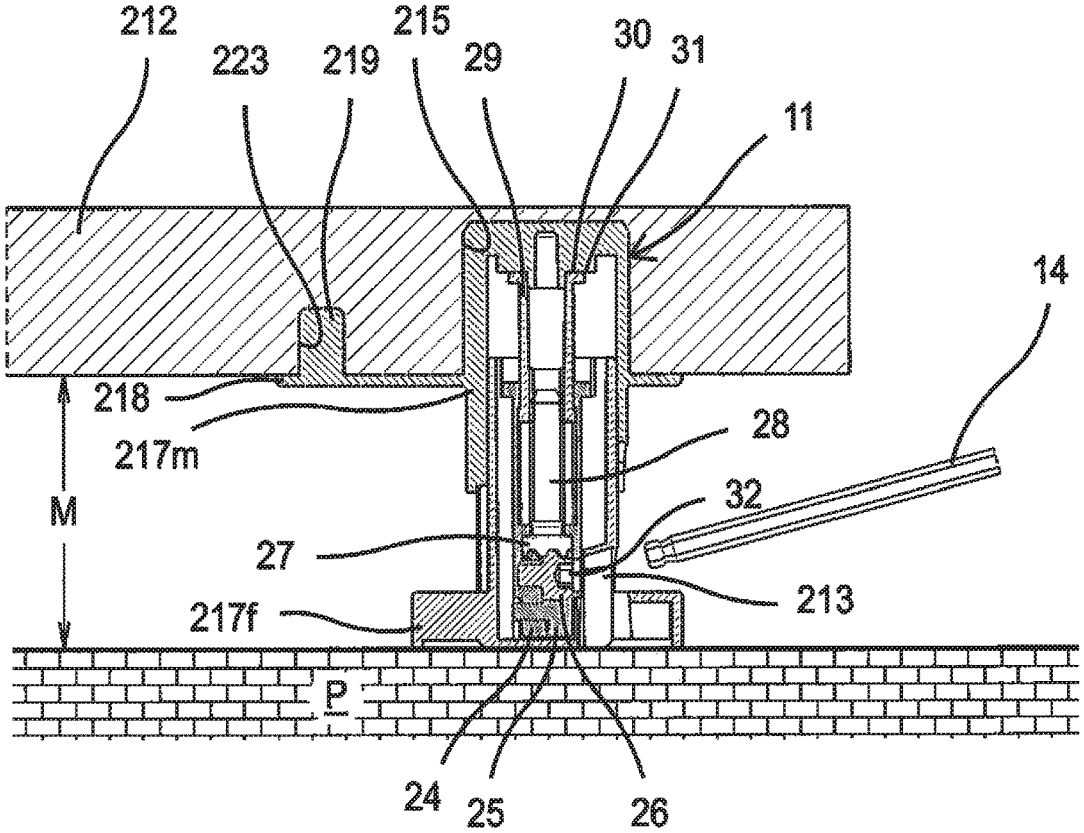

FIGS. 4 and 5 also show in a further embodiment of the system in which the foot 11 is positioned between a bottom 212 of the furniture and the floor P.

Also in this case, it can be seen how a space of the thickness of the bottom 212 has been exploited for ensuring an ample adjustment. An engagement seat 215 of an upper movable part 217*m* of the foot 11 has been formed in the interior of this thickness, thus inserting part of the adjustment mechanism in said thickness of the base. This upper movable part 217*m* of the foot 11 collaborates with the lower fixed part 217*f* of the foot 11 which is firmly positioned on the floor P and which provides the hole 213 or actuating point of the adjustment mechanism.

To improve the support between the parts and their stability, a wide flange 218 is provided in the upper movable part 217*m* of the body of the foot 11.

This flange 218 is also provided with one or more pins 219 positioned in seats 223 which help in orienting the foot during its insertion phase in the seat 215.

Once again, an extremely small distance M between flange 218 and the floor P has thus been obtained in which the manoeuvring tool 14 can be passed.

In FIGS. 4 and 5 it is illustrated, by way of example, how an adjustment mechanism can be actuated in height by means of a manoeuvring tool 14 inserted from the hole or actuating point 213.

Said adjustment mechanism is arranged in two half-shells 24, 25 positioned inside the lower fixed part 217*f* and the upper movable part 217*m* of the foot 11. In particular, the two half-shells house 24,25 in the lower part, a pinion 26 free to rotate, which is coupled with a toothed crown 27, also free to rotate. The toothed crown 27 is positioned at an end of a threaded screw 28 on which a sleeve 29 is housed, slidingly guided in the above half-shells 24, 25. An upper shaped end 30 of the sleeve 29 is abutted in an internal base portion 31 of the upper movable part 217*m* of the foot 11.

In this way, by placing the manoeuvring tool 14, passing from the hole or actuating point 213, to be housed in a recessed seat 32 of the pinion 26, its rotation is promoted. The rotation of the pinion 26 causes the rotation of the toothed crown 27 and consequently the threaded screw 28. This rotation forces the sleeve 29 to rise inside the two half-shells 24, 25 moving the upper movable part 217*m* of the foot 11 upwards. The adjustment in height of the foot is thus actuated.

FIGS. 6, 6*b* and 7, 7*b* are pairs of raised side views of a fourth embodiment of a foot system for parts of furniture and furnishing items with front adjustment levelling with adjustment on rear feet in two different positions.

Figure 6:
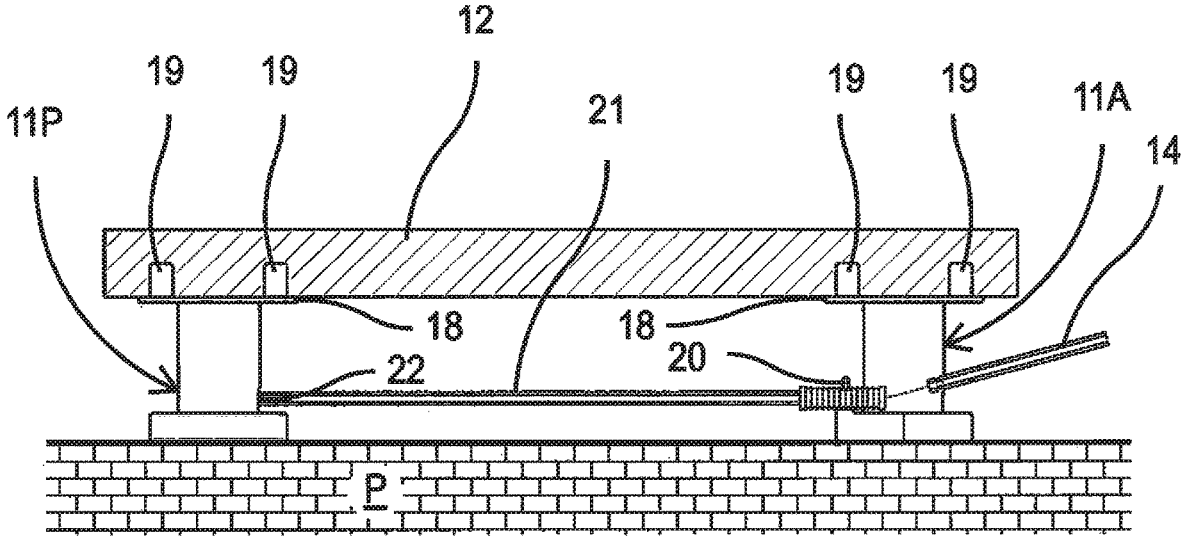
FIGS. 6, 6*b* and 7, 7*b* are two raised side views of a fourth embodiment of a foot system for parts of furniture and furnishing items with front adjustment levelling with adjustment on rear feet in two different positions.
Figure 6B:
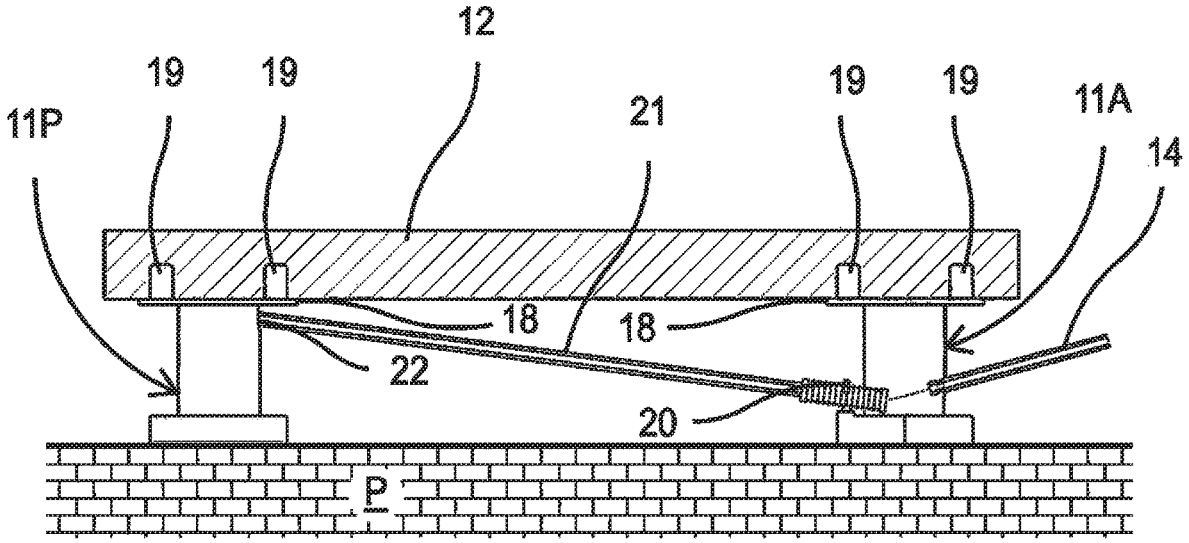

In particular, FIGS. 6 and 6*b* show a front foot 11A and a rear foot 11P. The front foot 11A provides a hook extension 20 integrated in the same for housing an end portion of a manoeuvring return rod 21 for adjusting the rear foot 11P. In the example of FIG. 6, the return rod 21 is inserted in a manoeuvring point 22 or hole formed in the rear foot 11P in a lower position.

FIG. 6*b*, on the contrary, shows a second example in which the return rod 21 is inserted in a manoeuvring point 22 or hole formed in the rear foot 11P in an upper position. In both cases, as already indicated, the hook extension 20 is integrated with the front foot 11A.

In both cases, the return rod 21 is fixed, in the front, in the front foot 11A, in a position close to the floor P.

Figure 7:
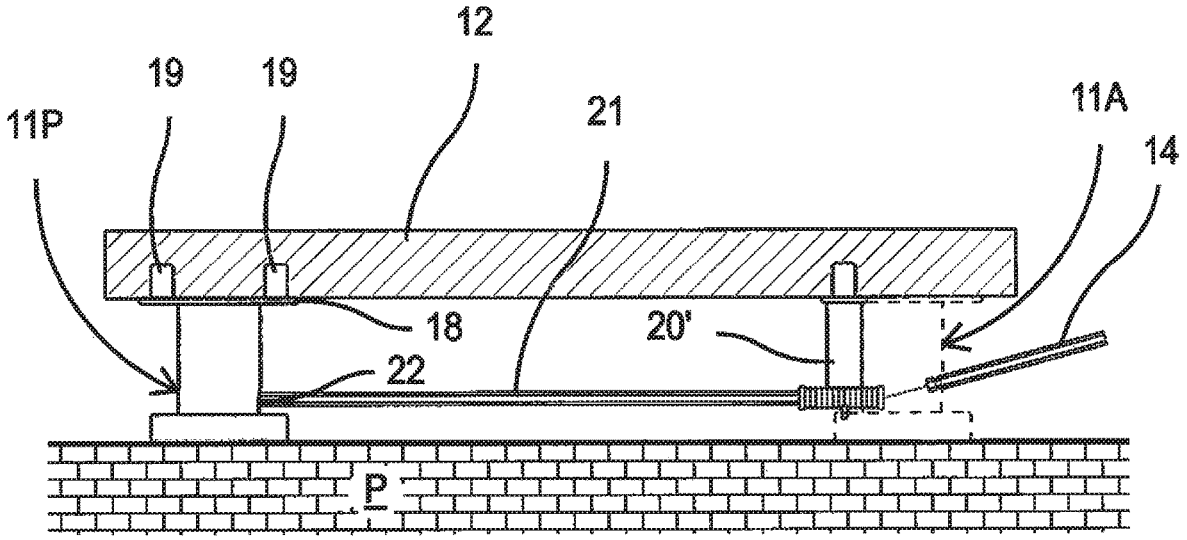
Figure 7B:
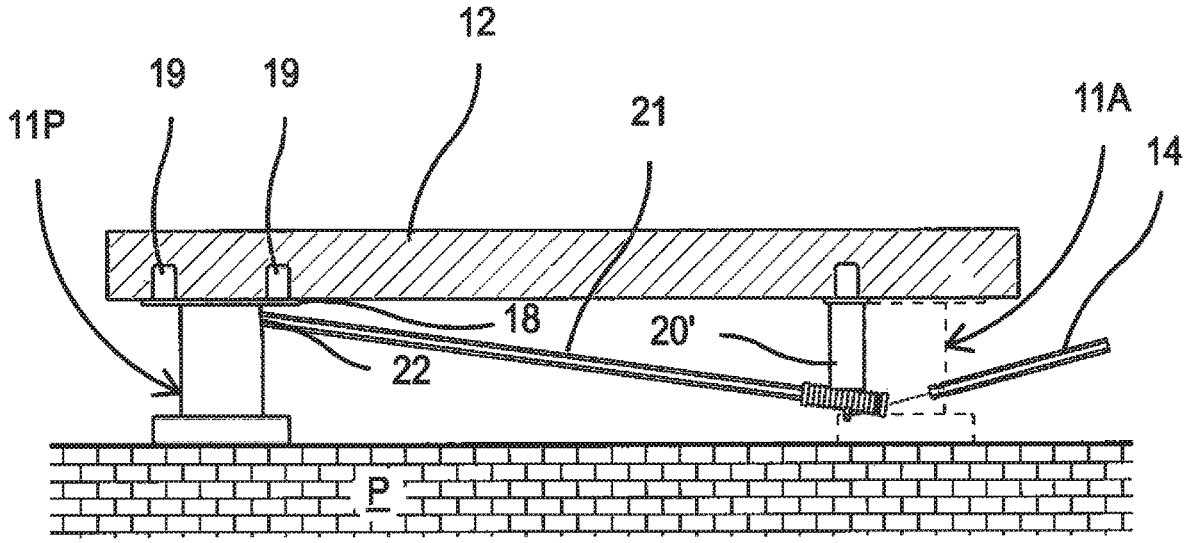

The further FIGS. 7 and 7*b* also show a front foot 11A and a rear foot 11P with a manoeuvring return rod 21 for adjusting the rear foot 11P. In this case, a hook extension 20' is provided, which extends from the base 12, constrained to the same, and is associated (cooperates) with the front foot 11A for housing an end portion of the manoeuvring return rod 21.

Identically to what is shown in FIGS. 6 and 6*b*, FIG. 7 also shows how the return rod 21 is inserted in a manoeuvring point 22 or hole formed in the rear foot 11P in a lower position.

FIG. 7*b*, on the contrary, shows how the return rod 21 is inserted in a manoeuvring point 22 or hole formed in the rear foot 11P in an upper position.

The forms of the structure for producing a system according to the present invention, as also the materials and assembly modes, can obviously differ from those shown for purely illustrative and non-limiting purposes in the drawings.

The objective mentioned in the preamble of the description has therefore been achieved.

The protection scope of the present invention is defined by the enclosed claims.

What is claimed is:

1. A foot system suitable for being used in parts of furniture and furnishing items with a base or bottom (12) with front adjustment levelling, comprising:

at least one foot (11), configured to be positioned between the base or bottom (12) of a piece of furniture and a floor (P) and; configured to contact the floor (P) in a space between said base or bottom of said piece of furniture and said floor is reduced in height (H), said at least one foot (11) contains in its interior a height adjustment mechanism in an interior part of said at least one foot, said height adjustment mechanism is configured to be actuated through a hole or an actuating point (13) by using a maneuvering tool (14), wherein said at least one foot (11) comprises a lower fixed part (17*f*) configured to contact the floor (P), wherein said hole or actuating point (13) is positioned at said lower fixed part (17*f*, 117*f*, 217*f*) at a free end of the at least one foot (11) resting on the floor (P), wherein the at least one foot (11) is sized and shaped such that: when the at least one foot (11) is in contact with said floor (P):

said height adjustment mechanism has a maneuvering angle (a) with respect to said floor (P), and an axis (X) of said at least one foot (11) is positioned in a retracted position of a space (R) with respect to a front part of said base or bottom (12) of the piece of furniture;

wherein said hole or actuating point (13) of said height adjustment mechanism is configured to allow an insertion of one end of the maneuvering tool (14) tilted by said maneuvering angle;

wherein the system comprises at least one front foot (11A) and a rear foot (11P), said front foot (11A) provides a hook extension (20) for housing an end portion of a maneuvering return rod (21) for an adjustment of the rear foot (11P), wherein said return maneuvering rod (21) is inserted in a maneuvering point or hole (22) formed in the rear foot (11P).

2. The system according to claim 1, wherein said at least one foot (11) having a flange (18) with one or more pins (19) adapted to be inserted in appropriate seats (23) formed in the base or bottom (12) for orienting the at least one foot hi its an insertion phase between the base (12) and the floor (P).

3. The system according to claim 1, wherein said base or bottom (12,112) provides, in a thickness (K) of an extension (116) towards the floor (P), an engagement seat (115) of the at least one toot (11) for inserting part of the height adjustment mechanism of the at least one foot.

4. The system according to claim 3, wherein a flange (118) is formed in an upper movable part (117) of a body of the at least one foot (11), which is abutted below the extension (116).

5. The system according to claim 3, wherein a flange (218) is provided in an upper movable part (217) of a body of the at least one foot (11), provided with one or more pins (219) positioned inside seats (223) of said base or bottom (212) for orienting the at least one foot during an insertion phase in a seat (215) of said base or bottom (212).

6. The system according to claim 1, wherein said maneuvering point or hole (22) is formed in a lower portion of the rear foot (11P) in a lower position of the same resting on the floor (P).

7. The system according to claim 1, wherein said maneuvering point or hole (22) is formed in an upper portion of the rear foot (11P).

8. The system according to claim 1, wherein said hook extension (20) is integrated in said front foot (11A).

9. The system according to claim 1, wherein said hook extension (20) is part of a hook element (20') which extends from the base or bottom (12) and which is associated with the front foot (11A).

10. The system according to claim 1, wherein said height adjustment mechanism comprises a casing (24,25) containing a pinion-toothed crown bevel (26,27) structured to allow a threaded screw (28) to move a sleeve (29) is abutted at an upper movable part (17*m*,117*m*,217*m*) integral with said base or bottom (12,112,212) of said piece of furniture.

* * * * *